US008739981B2

(12) United States Patent
Piskor

(10) Patent No.: US 8,739,981 B2
(45) Date of Patent: Jun. 3, 2014

(54) ANTI-SWEEP HOOK DEVICE

(75) Inventor: Simon Piskor, Quakers Hill (AU)

(73) Assignee: Exhibition Displays Australia Pty Ltd., Brookvale NSW (AU)

( * ) Notice: Subject to any disclaimer, the term of this patent is extended or adjusted under 35 U.S.C. 154(b) by 0 days.

(21) Appl. No.: 13/535,490

(22) Filed: Jun. 28, 2012

(65) Prior Publication Data

US 2013/0248469 A1 Sep. 26, 2013

(30) Foreign Application Priority Data

Mar. 20, 2012 (AU) ..... 2012201638

(51) Int. Cl.
*A47F 1/04* (2006.01)

(52) U.S. Cl.
USPC ..... 211/59.2; 211/59.1; 248/306

(58) Field of Classification Search
USPC ..... 211/4, 7, 54.1, 59.1, 59.2, 57.1; 248/306, 308, 551; 340/568.1, 568.8
See application file for complete search history.

(56) References Cited

U.S. PATENT DOCUMENTS

| | | | | |
|---|---|---|---|---|
| 3,481,482 | A * | 12/1969 | Wilkens | 248/220.41 |
| 3,827,569 | A * | 8/1974 | Canning | 211/7 |
| 5,711,432 | A * | 1/1998 | Stein et al. | 211/57.1 |
| 7,484,628 | B2 * | 2/2009 | Schneider | 211/57.1 |
| 7,768,399 | B2 * | 8/2010 | Hachmann et al. | 340/568.1 |

* cited by examiner

*Primary Examiner* — Korie H Chan
(74) *Attorney, Agent, or Firm* — Panitch Schwarze Belisario & Nadel LLP

(57) ABSTRACT

There is provided a display device for supporting a plurality of items for selection by an individual, comprising: at least one elongate member for receiving said items thereon; and a head member pivotally mounted to a free end of the elongate member, the head member having an arm portion and an end projection extending substantially perpendicular to the arm portion: the head member being movable between a biased position wherein the arm portion extends substantially parallel to said elongate member to permit sliding movement of an item past said arm portion and an engaged position wherein the arm portion extends outside of a planar axis of the elongate member to prevent sliding movement of an item past the arm portion; wherein movement of said head member between said biased position and said engaged position is facilitated by sliding movement of a leading item over said end projection.

10 Claims, 8 Drawing Sheets

ANTI-SWEEP HOOK DEVICE

BACKGROUND OF THE INVENTION

The present invention relates to a peg hook device for displaying merchandise for purchase in a commercial environment, and in particular, to a wire display hook that limits removal of multiple items of merchandise from the hook at a time.

In commercial environments, it is important to display merchandise available for purchase in a manner which is readily accessible by a potential buyer and which presents the item in a manner which provides easy inspection by the buyer.

It is common for many items that are offered for sale to be packaged in a manner whereby the items can be loaded onto a peg or wire hook. In this regard, the items typically comprise a slotted portion which receives the wire hook. The wire hook may be configured such that they are simply mounted at one end to a board, wall or stand, with the multiple items stored on the wire hook in a line for purchasing by a user. The distal end of the wire hook is typically provided with a hooked or similar configuration to prevent the frontmost or leading item from sliding off the hook In such a packaging arrangement, a carded portion of the packaging may be provided with the slot through which the wire hook is received and the items are suspended from the wire hook.

In such a conventional merchandise display arrangement, a buyer typically selects the frontmost or leading item from the wire hook and slides the item from the hook and over the hooked end thereof, where it is then purchased at a cash register or similar sales point. A variety of different configurations of the wire hook have been proposed for this purpose.

One problem with conventional wire hook displays is that a large number of items can be readily swept or removed from the wire hook display at any one time, through a simple sliding action. This has meant that thieves have been simply able to enter a commercial environment and remove all items from a conventional wire hook in a simple sliding motion and abscond without drawing attention to their actions. Further to this, it is also common for items to be dislodged from a conventional wire hook display through inadvertent contact with the wire hook.

A variety of alternative arrangements have been proposed to combat these problems with conventional wire hook displays. Such arrangements have sought to add a variety of security devices that attempt to provide controlled access to the distal end of the wire hook such that a buyer must actively manipulate the distal end of the wire hook to remove the item. Such devices include the provision of a key operated systems for releasing the distal end of the wire hook, re-designing the shape of the wire hook to make it more difficult to remove an item, or providing a cage about the distal end of the wire hook. Whilst such devices have proven effective in reducing the ability for a thief to simply sweep multiple devices from the wire hook in a single action, such devices have also caused frustration to legitimate purchases of the items, making the act of removing the items difficult to perform, thus acting as a disincentive to purchase the items.

Hence, there is a need to provide a device that functions as a conventional wire hook display device whilst providing enhanced security against theft of items therefrom.

The above references to and descriptions of prior proposals or products are not intended to be, and are not to be construed as, statements or admissions of common general knowledge in the art. In particular, the above prior art discussion does not relate to what is commonly or well known by the person skilled in the art, but assists in the understanding of the inventive step of the present invention of which the identification of pertinent prior art proposals is but one part.

BRIEF SUMMARY OF THE INVENTION

Accordingly, in a first aspect, there is provided a display device for supporting a plurality of items for selection by an individual, comprising:

at least one elongate member for receiving said items thereon; and a head member pivotally mounted to a free end of the elongate member, the head member having an arm portion and an end projection extending substantially perpendicular to the arm portion: the head member being movable between a biased position wherein the arm portion extends substantially parallel to said elongate member to permit sliding movement of an item past said arm portion and an engaged position wherein the arm portion extends outside of a planar axis of the elongate member to prevent sliding movement of an item past the arm portion;

wherein movement of said head member between said biased position and said engaged position is facilitated by sliding movement of a leading item over said end projection.

The elongate member may be a length of wire. The length of wire may mounted to a wall so as to extend from said wall to receive said items. The wall may be a wall of a display board or display stand for displaying said items for purchase by the individual.

The head member may be mounted to the free end of the elongate member by way of a pin member. The head member may be configured to mate with the free end of the elongate member to provide a substantially continuous sliding path over the arm portion of the head member when the head member is in the biased position. The free end of the elongate member may comprise a region of removed cross-sectional area within which the head member is received such that the combined cross sectional area of the free end of the elongate member and the head member is substantially equivalent to the cross section area of the elongate member.

The plurality of items may include a slot through which the elongate member is received such that the items are suspended from the elongate member. The individual may select the leading item for removal by sliding the leading item from the elongate member such that during the removal action the leading item contacts the end projection such that the arm portion of the head member prevents removal of any additional items.

The head member may be movable from the engaged position to the biased position by gravity forces acting on the arm portion of the head member.

BRIEF DESCRIPTION OF THE SEVERAL VIEWS OF THE DRAWINGS

The foregoing summary, as well as the following detailed description of the invention, will be better understood when read in conjunction with the appended drawings. For the purpose of illustrating the invention, there are shown in the drawings embodiments which are presently preferred. It should be understood, however, that the invention is not limited to the precise arrangements and instrumentalities shown.

In the drawings.

DETAILED DESCRIPTION OF THE INVENTION

Preferred features of the present invention will now be described with particular reference to the accompanying drawings. However, it is to be understood that the features illustrated in and described with reference to the drawings are not to be construed as limiting on the scope of the invention.

Figure 1:
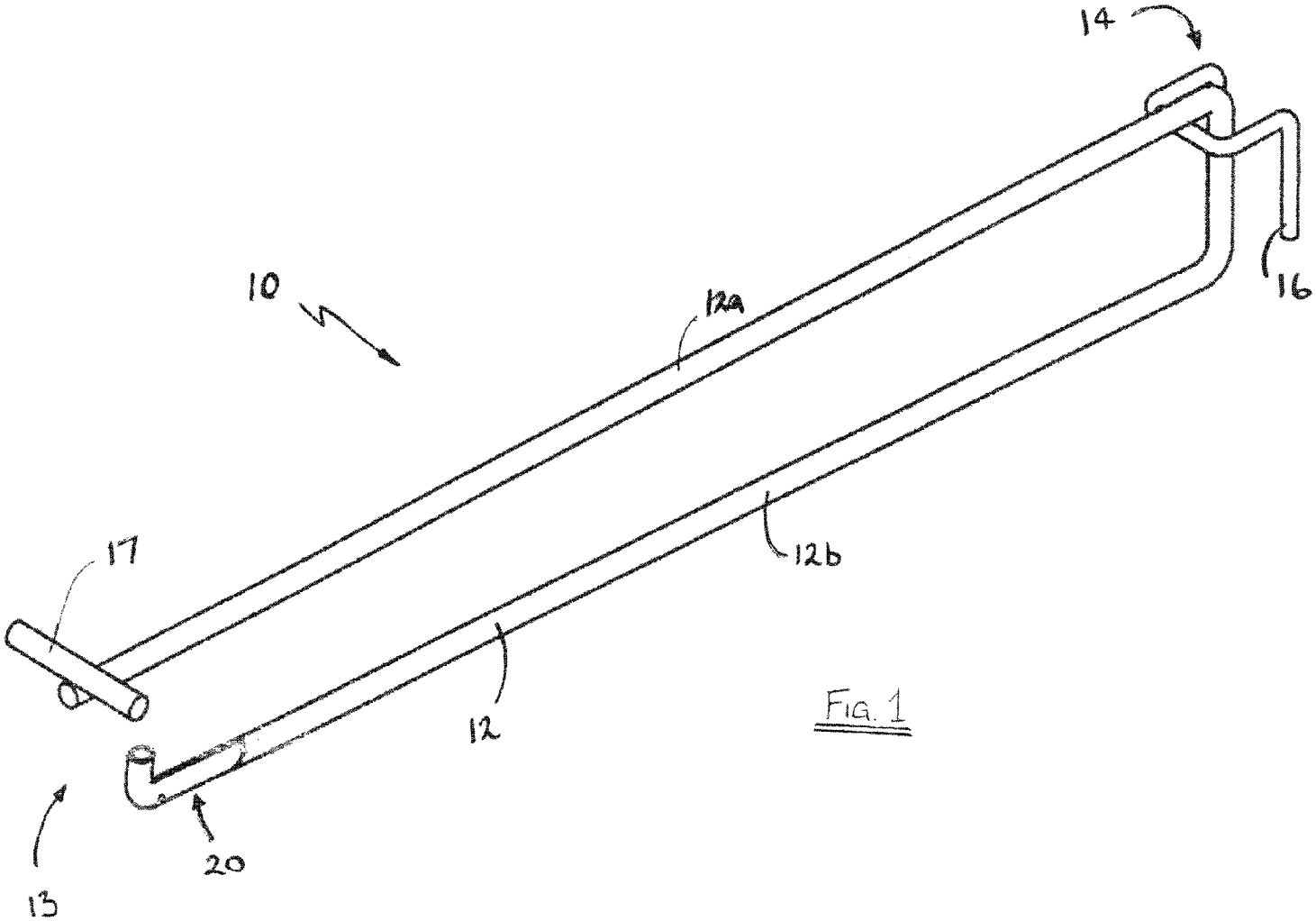
FIG. 1 is a perspective view of an embodiment of a wire hook display device in accordance with the present invention.
Figure 2:
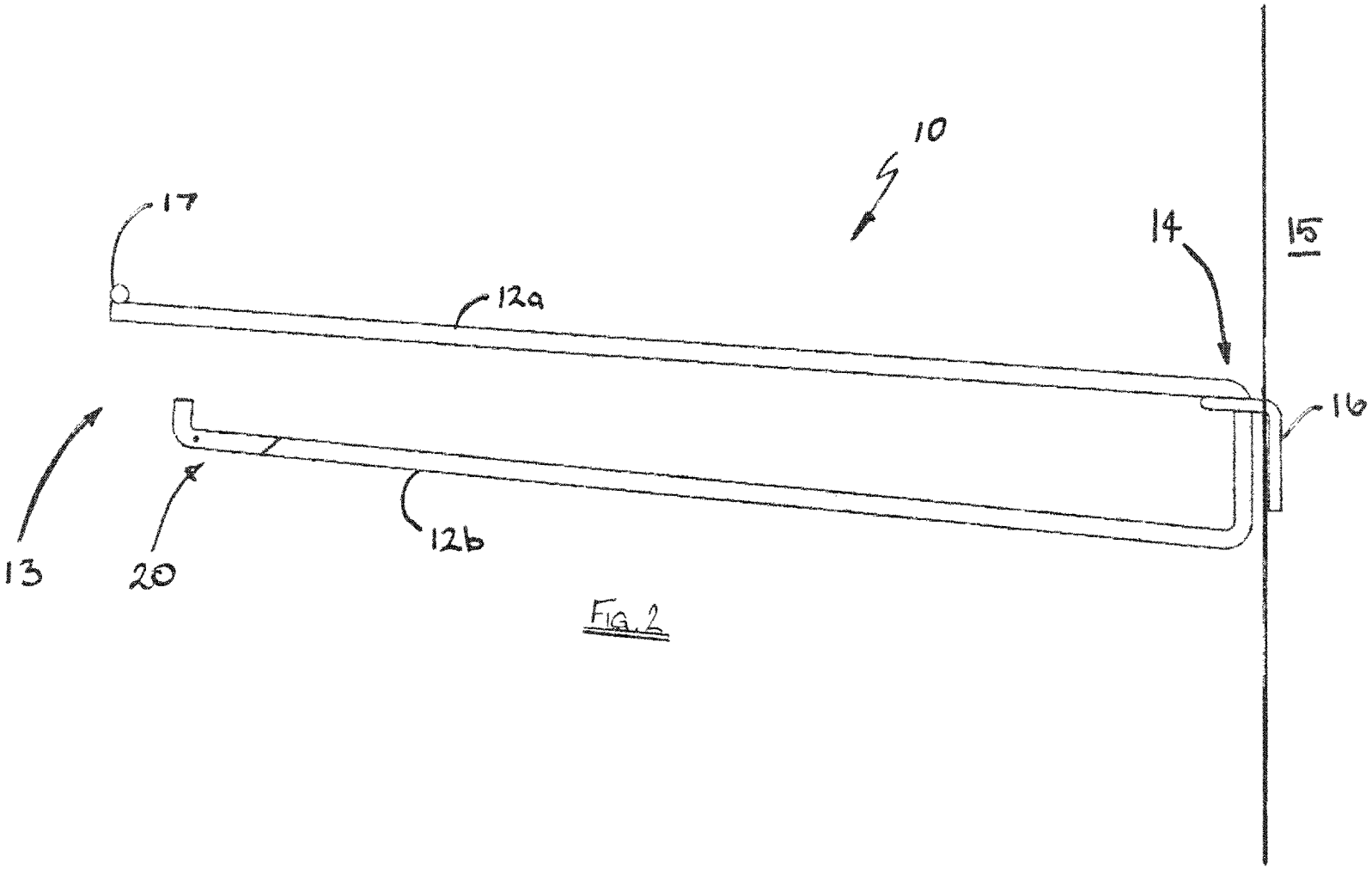
FIG. 2 is a side view of the device of FIG. 1.

Referring to FIG. 1 and FIG. 2, there is shown an embodiment of a display device 10, according to the present invention. The device 10 generally comprises an elongate member 12 preferably in the form of an elongate piece of wire or metal rod. The elongate or "wire" member 12 is bent or otherwise shaped so as to form an upper member 12*a* and a lower member 12*b*. The wire member 12 has a free or distal end 13 and a mounting end 14. The mounting end 14 is configured to be mounted to a wall 15, such as a display wall of a supermarket or retail outlet, or a display board or stand, as is shown in FIG. 2. A mounting member 16, such as a separate hook member, may be provided to facilitate mounting of the mounting end 14 to the wall 15 in the manner as shown.

When the device 10 is mounted to wall 15 in the manner as shown in FIG. 2, the lower member 12*b* and the upper member 12*a* of the wire member 12 extend substantially orthogonally therefrom, in a substantially parallel manner. In the embodiment as shown, the lower member 12*b* is angled upwardly with respect to the wall 15 a greater amount than the upper member 12*a*. However, it will be appreciated that the degree of inclination or declination of the upper member 12*a* and the lower member 12*b* may vary.

The distal or free end of the upper member 12*a* is provided with a cross member or bar 17 that extends substantially orthogonal thereto. The cross member 17 provides a means for mounting a display tag thereto when in use, to convey price or product information about the items of merchandise being displayed on the device 10.

Figure 6:
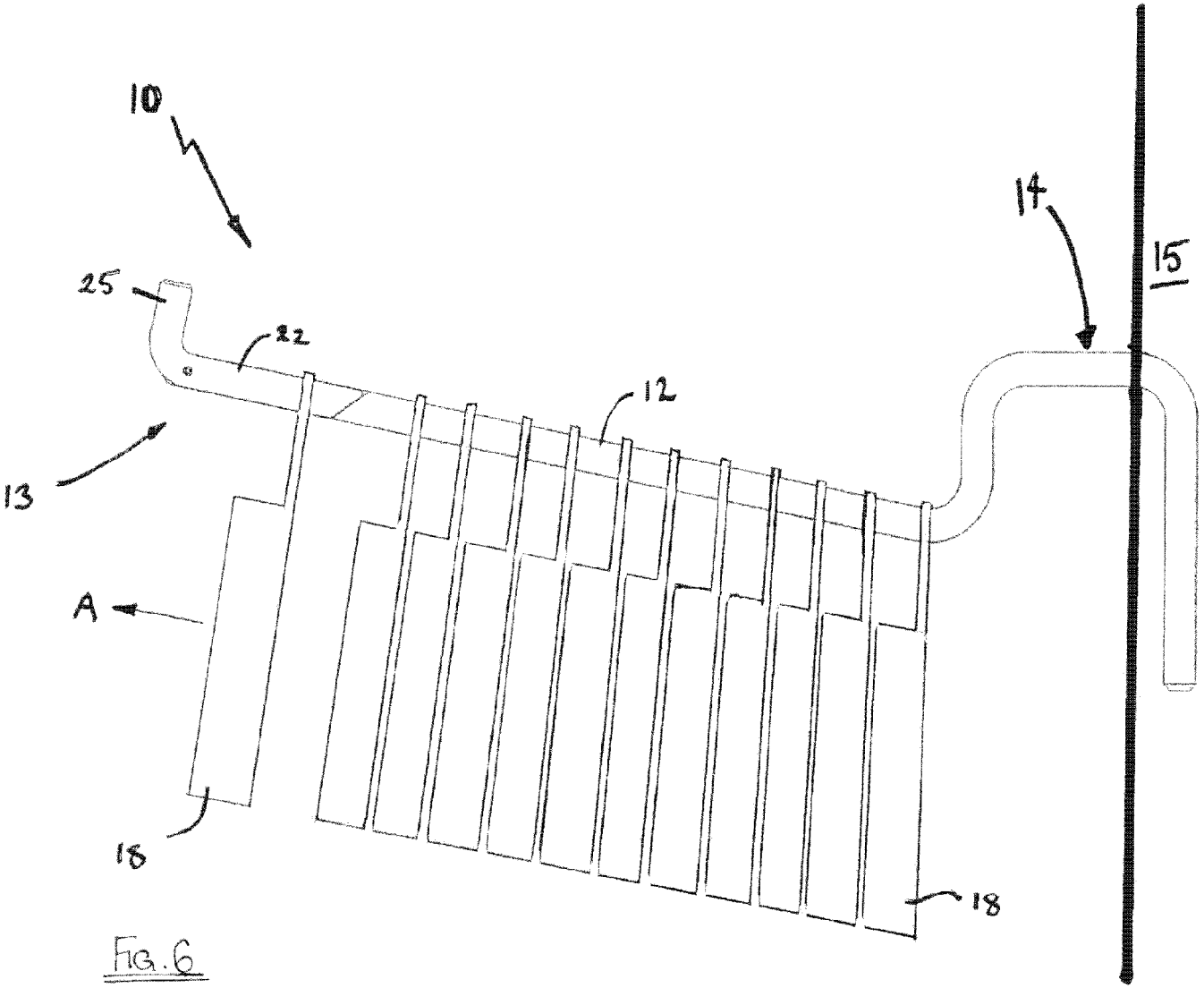
FIG. 6 is a side view of the wire hook display device of FIG. 3 storing a variety of items thereon.
Figure 7:
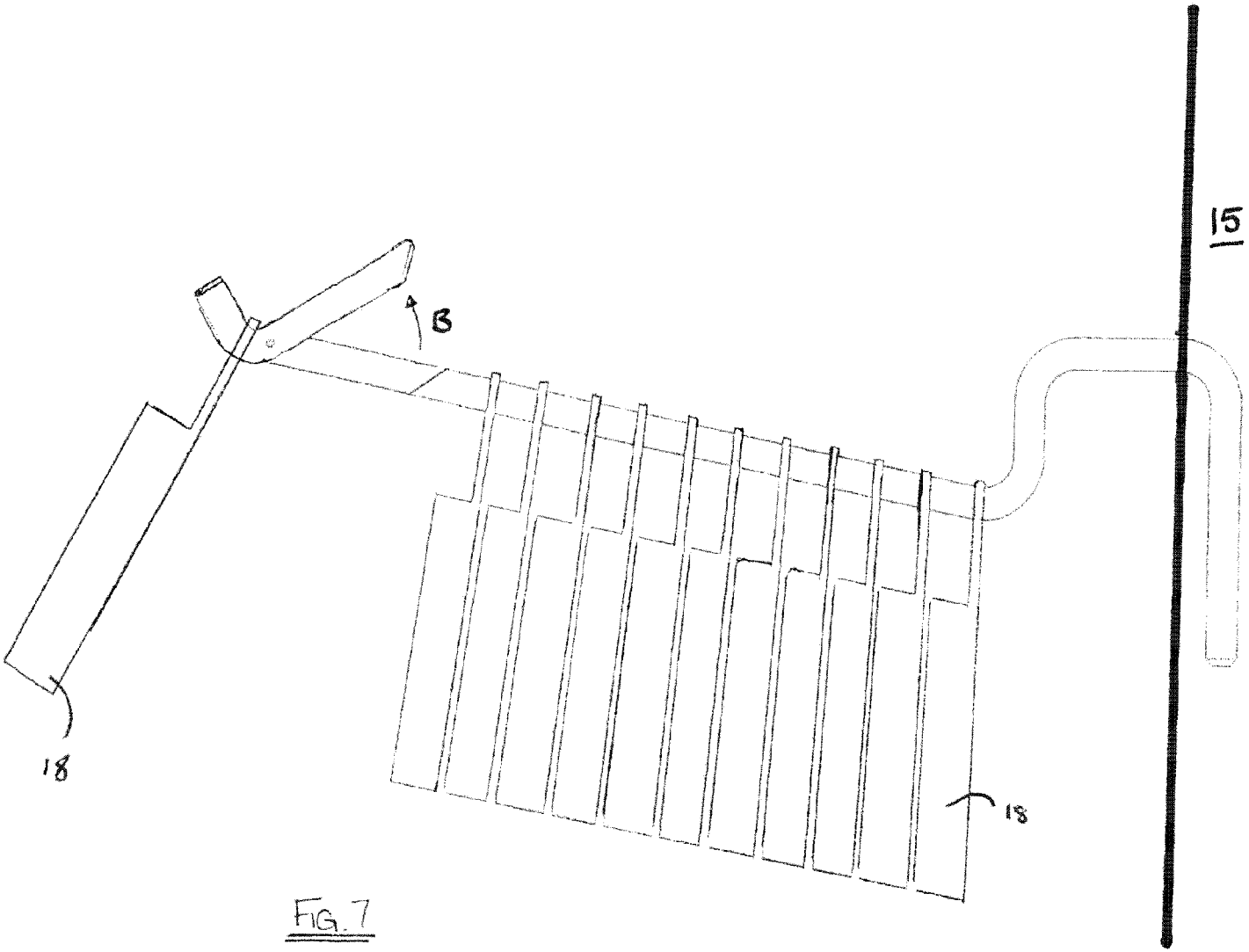
FIG. 7 is a side view of the wire hook display device of FIG. 3 in use preventing multiple removal of items stored thereon.
Figure 8:
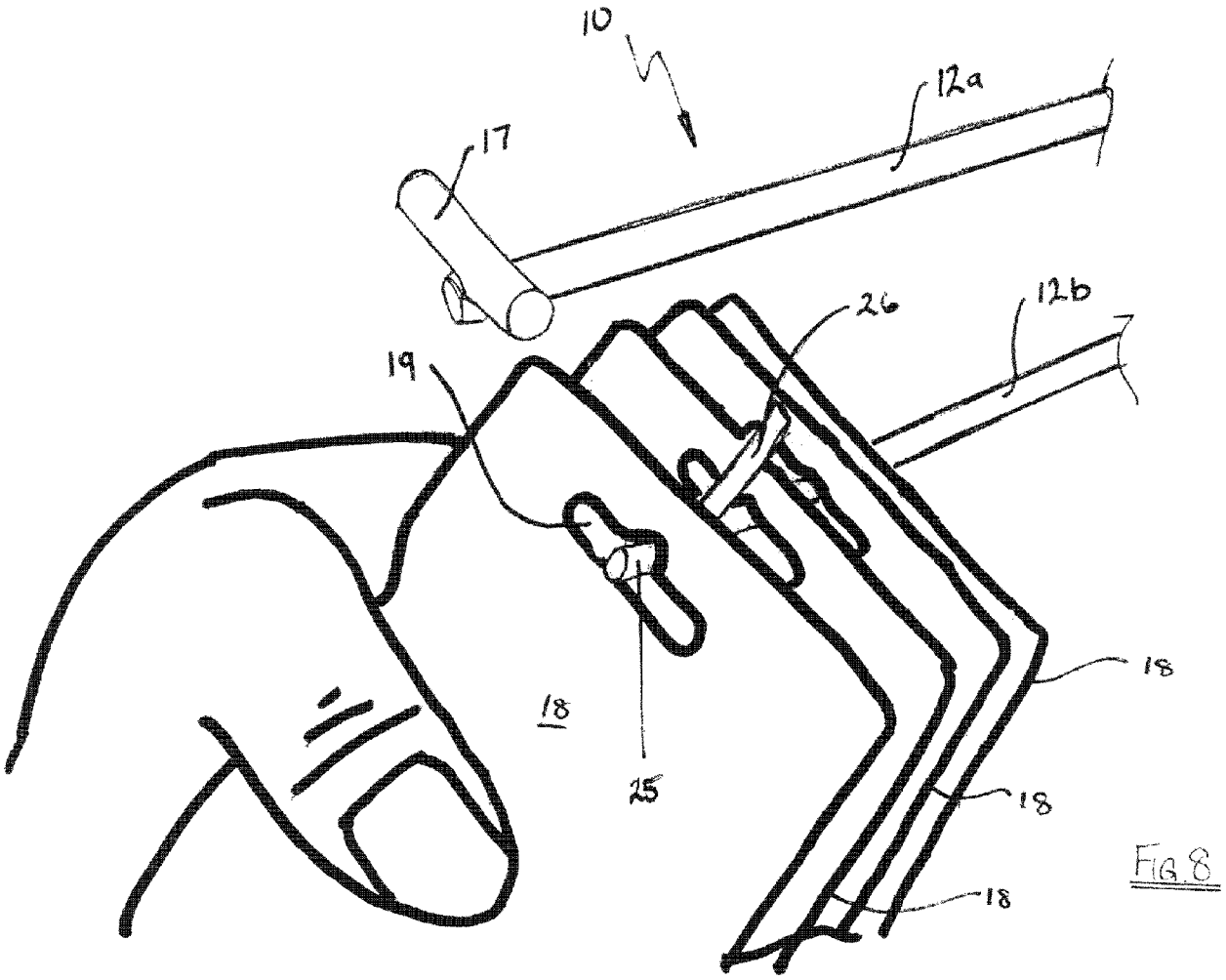
FIG. 8 is a front perspective view of the display device of FIG. 1 in use preventing multiple removal of items stored thereon.

When in use, and as is shown in more detail in FIGS. 6-8, the lower member 12*b* is configured to receive one or more items 18 thereon. Each item 18 has a slot 19 formed at an upper region thereof to receive the lower member 12*b* such that the item 18 is hung or is suspended from the lower member 12*b*. In this regard, the slot 19 may have a rut or groove formed in a central region thereof which locates around the lower member 12*b* so as to position the items 18 centrally along the lower member 18, in the manner as shown more clearly in FIG. 8. It will be appreciated that multiple items 18 may be placed along the lower member 12*b* so as to form a line of items 18 that extends from the mounting end 14 to the free or distal end 13. By arranging the items 18 in the manner as described, a buyer can readily view and access the items available for sale.

The distal or free end 13 of the lower member 12*b* is provided with a hook member 20. The hook member 20 will be described in more detail below, but defines the point at which an item 18 is able to be removed from the device 10. In the state as shown in FIGS. 1 and 2, the hook member 20 projects substantially orthogonal with respect to the lower member 12*b* and acts as a stop means that prevents the items 18 from merely sliding off the end of the lower member 12*b*.

Figure 3:
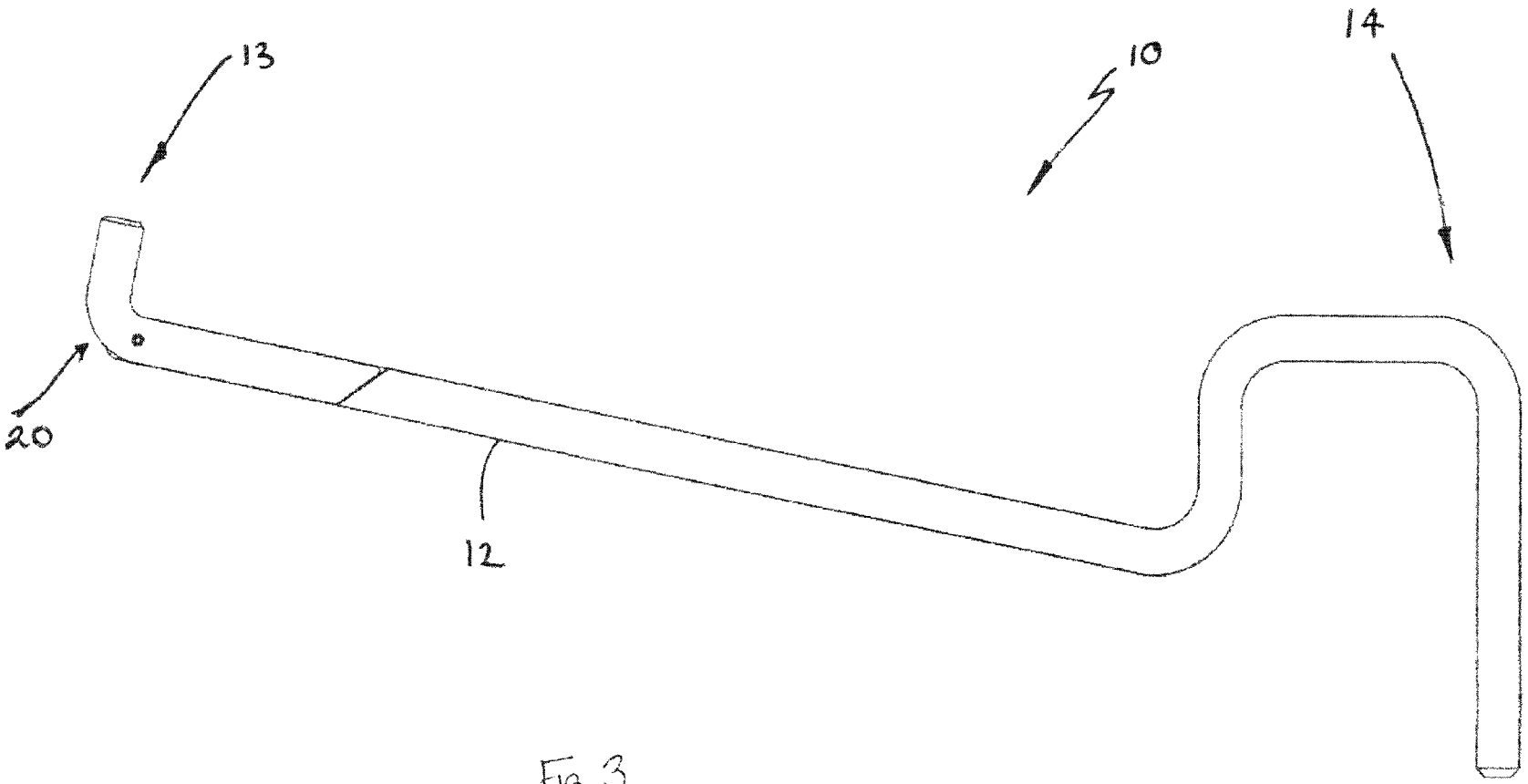
FIG. 3 is a side view of an alternative embodiment of a wire hook display device in accordance with the present invention.

Referring to FIG. 3, an alternative embodiment of a wire hook display device 10 is shown. In this embodiment, the wire member 12 is shaped to form a single elongate length of wire or metal rod with the mounting end 14 of the wire member shaped to be mounted to a wall 15, such as a display wall of a supermarket or retail outlet, or a display board or stand, as is shown in FIGS. 6 and 7. In the embodiment of FIG. 3, the items 18 are mounted to the wire member 12, in the manner as shown in FIG. 6, with the hook member 20 functioning as the point at which the items are to be removed from the device 10.

Figure 4:
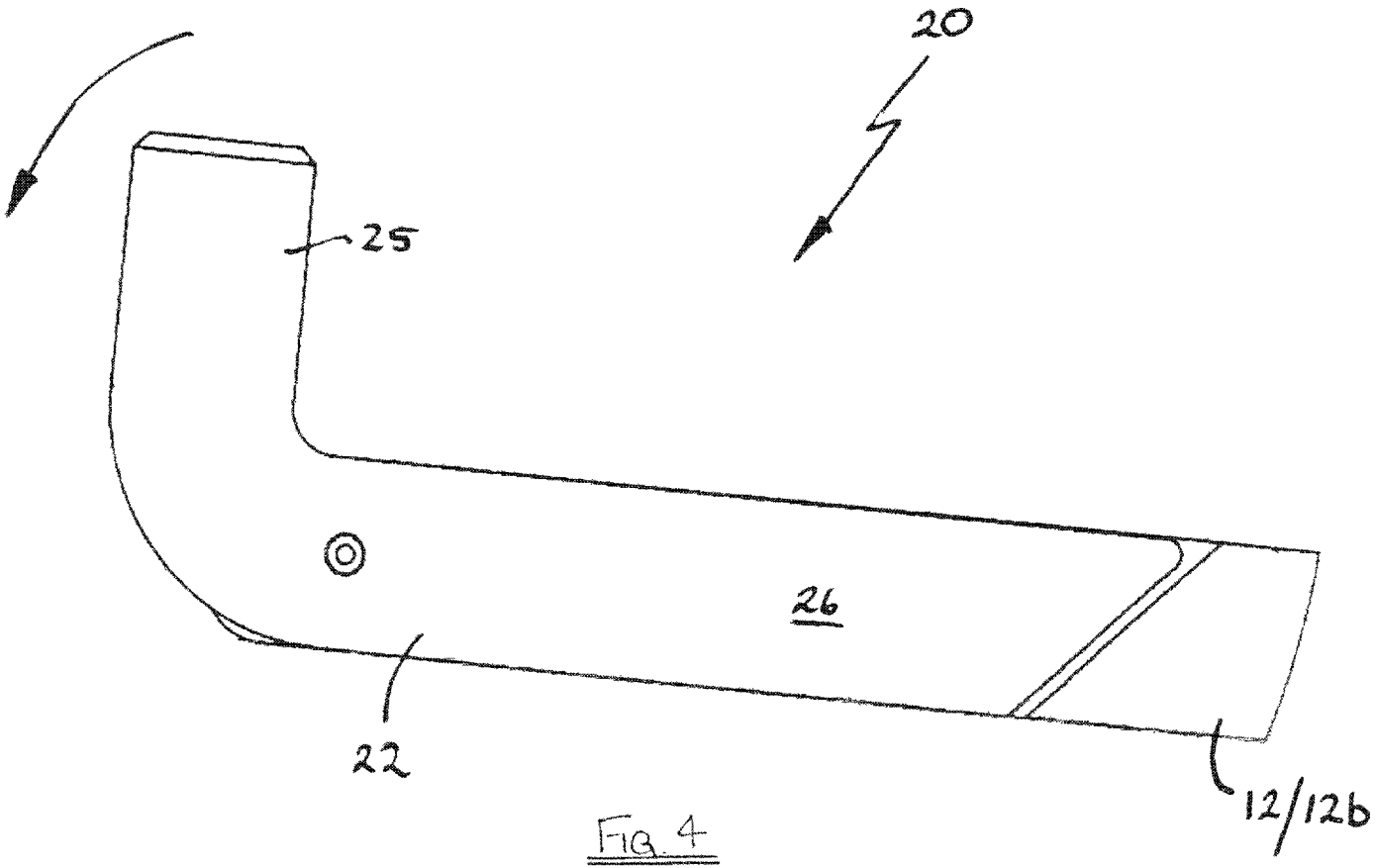
FIG. 4 is an enlarged view of a hooked end of the wire hook display device of FIGS. 1 and 3.
Figure 5:
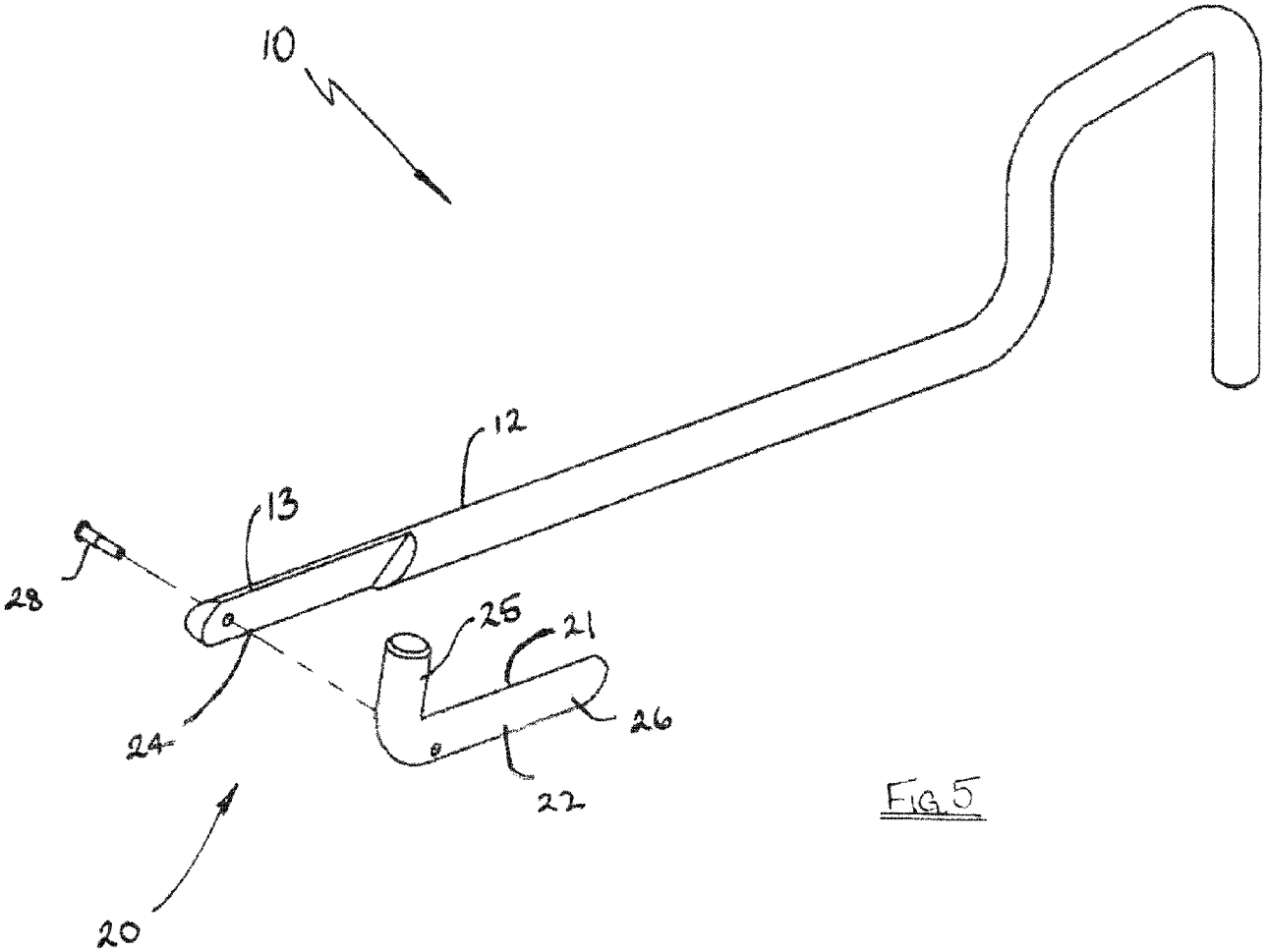
FIG. 5 is an exploded perspective view of the wire hook display device of FIG. 3.

Referring to FIGS. 4 and 5, the hook member 20 is shown in detail. The hook member 20 comprises a head member 22 that is pivotally mounted to the distal end of the wire member 12 or lower member 12*b* of the device 10. To accommodate the head member 22, the distal end of the wire member 12 or lower member 12*b* has a removed region 24 formed along a side thereof, as shown. The removed region 24 forms a substantially flat or planar surface that extends substantially upright with respect to the device 10, such that the distal end 13 has a reduced width.

The head member 22 is configured to substantially conform to the distal end 13 of the wire member 12. In this regard, the head member has a substantially planar inside face 21 that is configured to be received against the removed region 24 of the wire member 12. When the head member 22 is brought into position against the distal end 13 wire member 12, the distal end 13 of the wire member 12 and the head member together form a cylindrical shape that is substantially the same width and diameter as the wire member 12, so as to provide a substantially smooth transition between the wire member 12 and the head member 22.

The head member 22 comprises an end projection 25 that extends substantially perpendicular to the arm portion 26 upon which the planar inside face 21 is formed. In this regard, the arm portion 26 and the end projection 25 of the head member 22 form an L-shape.

The head member 22 is mounted to the distal end 13 of the wire member 12 by way of a pin member 28. The pin member 28 may be a rivet member that is configured to pass through recesses 29 formed through the head member 22 and the wire member 12 respectively, so as to secure the head member 22 and the wire member 12 together. The head member 22 is able to pivot about the axis of the pin member 28 due to the fact that the planar inside face 21 is located adjacent the planar face of the removed region 24 of the wire member 12.

The rotational movement of the head member 22 with respect to the wire member 12 is controlled by the angled manner in which the removed region 24 is formed in the wire member 12 and the angled end region of the arm portion 26 of the head member, as is shown more clearly in FIG. 4. The head member 22 is able to rotate between a biased position, whereby the arm portion 26 of the head member extends substantially parallel with the axis of the wire member 12 such that the end projection 25 extends substantially perpendicular to the axis of the wire member 12 (as shown in FIG. 4) and an engaged position, whereby the arm portion 26 of the head member projects above the axis of the wire member 12 (as shown in FIG. 7). Due to the angled manner in which the head member 22 and the removed region 24 are formed, the head member 22 is prohibited from rotating beyond the biased position as, when in the biased position, the arm portion 26 of the head member is in contact with the wire member 12.

Referring to FIG. 6, the manner in which the wire hook display device 10 functions in use can be appreciated. The device 10 is provided to receive a plurality of items 18 for purchase by a customer. The items 18 are each located on the wire member 12 in a row and are suspended therefrom whereby a customer can readily view the items 18 prior to removal from the device 10.

If a customer wishes to purchase an item 18 from the device 10, the customer typically selects the frontmost or leading item 18 and slides the item toward the distal end 13 of the wire member 12, as is shown by arrow A. As the item 18 is slid towards the distal end 13 of the wire member 12, the item 18 comes into contact with the end projection 25 of the head member 22, due to the end projection 25 extending above the wire member 12.

By continuing to slide the leading item 18 over the end projection 25, the head member 22 is caused to pivot about the pin axis such that the arm portion 26 moves in the direction of arrow B, as shown in FIG. 7. In this position the arm portion 26 prevents any later items 18, or items 18 located behind the leading item 18 from being slid along the wire member 12 and off the end of the device 10, by acting as a physical barrier to such sliding movement.

As the arm portion 26 pivots, so does the end projection 25 such that the customer can merely slide the leading item 18 off the end of the device 10 and take the item 18 to a payment point to complete the purchase. Due to the weight of the arm portion 26 of the head member 22, the head member will naturally return to its biased position (as shown in FIG. 6), and the next item 18 will then become the lead item for purchase.

As is shown in FIG. 8, the device 10 provides a simple yet effective means for preventing removal of multiple items 18 from the wire member 12. As is shown, as soon as the leading item 18 comes into contact with the end projection 25 of the head member 22, the arm portion is caused to pivot above the wire member 12 thereby preventing any further sliding movement of the items located behind the leading item. This prevents a thief from sweeping items from the device 10 is a single action and functions as a deterrent to thieves, as the only way in which to remove multiple items from the device is to carefully remove the items one at a time, which greatly increases a thief's chances of being noticed.

It will be appreciated that the device 10 of the present invention provides a simple means for removing a single item for purchase and retains many of the benefits of conventional wire hook display devices. However, whilst retaining the benefits of conventional devices when used for single removal of items, the device of the present invention provides a theft deterrent for removal of multiple items by simply utilizing the natural sliding action of an item sliding over the end projection of the head member to block further sliding movement of any items behind the lead item. It will be appreciated that the device of the present invention achieves this without requiring any significant additional parts or locking mechanisms, but merely utilizes the inherent design of existing devices to achieve a novel and inventive purpose.

Throughout the specification and claims the word "comprise" and its derivatives are intended to have an inclusive rather than exclusive meaning unless the contrary is expressly stated or the context requires otherwise. That is, the word "comprise" and its derivatives will be taken to indicate the inclusion of not only the listed components, steps or features that it directly references, but also other components, steps or features not specifically listed, unless the contrary is expressly stated or the context requires otherwise.

Orientational terms used in the specification and claims such as vertical, horizontal, top, bottom, upper and lower are to be interpreted as relational and are based on the premise that the component, item, article, apparatus, device or instrument will usually be considered in a particular orientation, typically with the device uppermost.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

I claim:

1. A display device for supporting a plurality of items for selection by an individual, comprising:

at least one elongate member for receiving said items thereon, the elongate member having a free end with a distal region from which the items are to be removed, the distal region of the free end having a recess formed therein; and a head member having an arm portion and an end projection extending substantially perpendicular to the arm portion, the arm portion having a length greater than a length of the end projection;

wherein the head member is mounted to the free end of the elongate member such that the arm portion is received within said recess to extend substantially parallel to said elongate member with the end projection extending in an u s ward manner from the free end of the elongate member the head member being free to pivot with respect to the elongate member about a pivot point such that upon sliding movement of an item along said elongate member towards the free end, contact of said item with the end projection will cause said end projection to pivot in a downward direction thereby raising the arm portion above an upper surface of the elongate member to prevent siding movement of subsequent items along the elongate member, and wherein upon removal of contact of said item with the end projection, the arm portion will return, under gravity, to be received within the recess to extend substantially parallel to said elongate member.

2. The display device according to claim 1, wherein the elongate member is a length of wire.

3. The display device according to claim 2, wherein the length of wire is mounted to a wall so as to extend from said wall to receive said items.

4. The display device according to claim 3, wherein the wall is a wall of a display board or display stand for displaying said items for purchase by the individual.

5. The display device according to claim 1, wherein the head member is mounted to the free end of the elongate member by way of a pin member.

6. The display device according to claim 5, wherein head member is configured to mate with the distal region of the free end of the elongate member to provide a substantially continuous sliding path over the arm portion of the head member substantially parallel to said elongate member.

7. The display device according to claim 6, wherein the recess formed in the distal region of the free end of the elongate member comprises a region of removed cross-sectional area within which the head member is received such that the combined cross sectional area of the free end of the elongate member at the recess and the head member is substantially equivalent to the cross section area of the elongate member away from the recess.

8. The device according to claim 6 wherein the recess extends along only one lateral side of the one elongate member.

9. The device according to claim 8 wherein a distal free end of the arm portion is angled in a direction transverse to the end projection and the arm portion and wherein an innermost end of the recess most proximal to the distal free end of the arm portion is angled transverse to the elongate member to form a stop contacting the distal free end of the arm portion with the arm portion substantially parallel to said elongate member so as to stop rotation of the arm portion at a position substantially parallel with the elongate member.

10. The device according to claim 9 having only the one elongate member to receive and support the items.

* * * * *